US011286961B2

(12) United States Patent
Bachmaier et al.

(10) Patent No.: US 11,286,961 B2
(45) Date of Patent: Mar. 29, 2022

(54) ACTUATOR DEVICE AND METHOD FOR OPERATING SUCH AN ACTUATOR DEVICE

(71) Applicant: MetisMotion GmbH, Munich (DE)

(72) Inventors: Georg Bachmaier, Munich (DE); Patrick Fröse, Munich (DE); Matthias Gerlich, Munich (DE); Wolfgang Zöls, Munich (DE)

(73) Assignee: MetisMotion GmbH, Munich (DE)

( * ) Notice: Subject to any disclaimer, the term of this patent is extended or adjusted under 35 U.S.C. 154(b) by 0 days.

(21) Appl. No.: 17/271,935

(22) PCT Filed: Aug. 8, 2019

(86) PCT No.: PCT/EP2019/071332
§ 371 (c)(1),
(2) Date: Feb. 26, 2021

(87) PCT Pub. No.: WO2020/048723
PCT Pub. Date: Mar. 12, 2020

(65) Prior Publication Data

US 2021/0317847 A1 Oct. 14, 2021

(30) Foreign Application Priority Data

Sep. 4, 2018 (DE) ..... 10 2018 214 970.4

(51) Int. Cl.
*F15B 7/00* (2006.01)
*F15B 7/02* (2006.01)
*F15B 11/12* (2006.01)

(52) U.S. Cl.
CPC ..... *F15B 7/001* (2013.01); *F15B 7/02* (2013.01); *F15B 11/12* (2013.01)

(58) Field of Classification Search
CPC ..... F15B 7/001; F15B 7/08; F15B 11/12
See application file for complete search history.

(56) References Cited

U.S. PATENT DOCUMENTS 4,698,971 A 10/1987 France
6,637,200 B2 * 10/2003 Barba ..... F04B 43/046 60/473

FOREIGN PATENT DOCUMENTS

DE 3116687 A1 11/1982
DE 19705893 A1 8/1998
(Continued)

OTHER PUBLICATIONS

PCT; App No. PCT/EP2019/071332; International Search Report and Written Opinion dated Nov. 5, 2019.

*Primary Examiner* — F Daniel Lopez
(74) *Attorney, Agent, or Firm* — Fitch, Even, Tabin & Flannery, LLP

(57) ABSTRACT

The invention provides an actuator device, which has: an output element, which is acted on by a fluid and as a result is movable into a holding position; two solid-state actuators, which are able to be activated alternately; a coupling element common to the solid-state actuators; a discharge duct, via which the fluid is able to be discharged from the output element; and at least one valve element, which is adjustable between a blocking closed state and an open state, in which the valve element allows the fluid to be discharged from the output element via the discharge duct and allows the output element to move from the holding position into at least one yielding position, wherein the valve element is actuable, via the coupling element of the respective solid-state actuator, by the respective activation of the solid-state actuator and is able to be moved into the closed state.

16 Claims, 2 Drawing Sheets

(56) References Cited

FOREIGN PATENT DOCUMENTS

| | | | |
|---|---|---|---|
| DE | 102015206035 | A1 | 10/2016 |
| DE | 102016208773 | A1 | 11/2017 |
| EP | 2984747 | B1 | 11/2017 |
| KR | 20170055880 | A | 5/2017 |
| WO | 2017178814 | A1 | 10/2017 |
| WO | 2018146035 | A1 | 8/2018 |

* cited by examiner

ACTUATOR DEVICE AND METHOD FOR OPERATING SUCH AN ACTUATOR DEVICE

CROSS-REFERENCE TO RELATED APPLICATIONS

This application is a U.S. national phase application of International Application No. PCT/EP2019/071332, filed Aug. 8, 2019, designating the United States, which claims priority to German Application No. 10 2018 214 970.4, filed Sep. 4, 2018.

FIELD

The invention relates to an actuator device as well as to a method for operating such an actuator device.

BACKGROUND

In many safety-relevant applications such as for example power switches, lifts, robots, conveying systems etc., actuators such as for example safety switches, clamping units and/or brakes are advantageous, which for example are to switch the respective system to zero-force and/or zero-voltage as fast as possible and/or are to bring it fast to stop by specifically braking in case of emergency. Often, times of less than 10 milliseconds are requested to effect a desired state of the system by the respective actuator, that is for example to switch the system to zero-force and/or zero-voltage and/or to brake it. In order to be able to fast adjust the desired state by the respective actuator, large forces can be required on the one hand. However, on the other hand, high functional safety of the actuator is also desirable. This means that the respective actuator should autonomously adopt a securing state or change to a safe state upon a failure of the voltage supply or upon a defect of electronics.

Braking, releasing and/or switching are usually effected via releasing a force storage and/or a corresponding contact force. Therein, a potential energy required hereto is established with the aid of a spindle and/or with the aid of a hydraulic and/or pneumatic cylinder and released or reset via a triggering unit. Thereby, force generation is mostly separately effected with the aid of a pump or an electric motor, and releasing is effected with the aid of an electromechanical triggering unit or a valve. For example, if the functional safety provides state monitoring, then, a force, pressure and/or position sensor is additionally also advantageous. Further, hydraulic or pneumatic components are required in systems with higher force density, but which can entail systemic disadvantages or is also prohibited for different reasons, in particular with regard to a media supply, maintenance effort and a high installation space requirement.

Therefore, it is the object of the present invention to provide an actuator device as well as a method for operating such an actuator device, such that a desired state of a system or a device can be fast and securely brought about by the actuator device and by the method, respectively.

SUMMARY

This object is solved by the subject matters of the independent claims. Advantageous configurations with convenient developments of the invention are specified in the dependent claims.

A first aspect of the invention relates to an actuator device, in particular for a system or for a device. A desired and in particular safe state of the system can for example be effected, in particular adjusted, by the actuator device in short time. The desired state can be fast and particularly securely adjusted or effected by the actuator device according to the invention since a particularly high functional safety of the actuator device according to the invention itself can be realized.

Hereto, the actuator device according to the invention comprises at least one output element, which can be applied with a fluid, in particular with a liquid, and thereby is movable into a holding position as well as is able to be held, that is can be held, in the holding position for example against a load acting on the output element. Thus, the actuator device can for example provide an opposite force counteracting the load via the output element to thereby for example hold the previously mentioned system in a first state of the system in particular if the system is in normal operation and does not have a malfunction.

For example, the mentioned load is a force and/or a torque and/or another load, which can for example act from at least one component of the system to the actuator device, in particular to the output element, in particular in the normal operation. In the completely produced state of the system, the system can include the actuator device. In other words, the actuator device according to the invention can be a constituent of the system in the completely produced state of the system.

Moreover, the actuator device includes at least two solid-state actuators. For example, one of the solid-state actuators is also referred to as first solid-state actuator, wherein the other one of the solid-state actuators is also referred to as second solid-state actuator. The solid-state actuators are alternately activatable or activated. By alternately activating the solid-state actuators, the fluid can be conveyed to the output element by the solid-state actuators, whereby the output element can be or is applied with the fluid. In that the solid-state actuators, which are simply also referred to as actuators, are alternately activated, the respective solid-state actuator is for example alternately activated and not activated viewed in itself. Thus, active phases and inactive phases of the respective actuator consecutively alternate such that a respective inactive phase of the respective actuator follows a respective active phase of the respective actuator. During or in the active phase, the respective actuator is activated. In other words, activation of the respective actuator is effected in or during the respective active phase of the respective actuator, wherein activation of the respective actuator is omitted in or during the respective inactive phase. Since the actuators are alternately activated, the first solid-state actuator is for example in its active phase, while the second solid-state actuator is in its inactive phase, and the first solid-state actuator is in its inactive phase, while the second solid-state actuator is in its active phase. For example, exactly one inactive phase of the respective actuator is between two directly or immediately consecutive active phases of the respective actuator, and exactly one active phase of the respective actuator is between two immediately or directly consecutive inactive phases of the respective actuator. By the feature that the two active or inactive phases immediately or directly follow each other, it is to be understood that no further other active or inactive phases are between the two immediately or directly consecutive active or inactive phases.

The fluid can be a gas. However, the fluid is preferably an, in particular at least substantially incompressible, liquid such that the output element is for example a hydraulic output element or a hydraulically actuatable or operable output element.

Moreover, the actuator device includes a coupling element common to the solid-state actuators as well as at least one discharge duct, via which the fluid can be discharged from the output element. In other words, the fluid, which is conveyed or was conveyed to the output element by the respective actuator, for example to thereby apply the output element with the fluid and to move it into the holding position or hold it in the holding position, can be discharged from the output element.

Moreover, the actuator device comprises at least one valve element for example formed as a check valve, which is adjustable between at least one closed state blocking the discharge duct and at least one open state unblocking the discharge duct. This means that the discharge duct is blocked, that is fluidically blocked or fluidically closed, by the valve element in the closed state such that the discharge duct cannot be flown through by the fluid. However, the valve element unblocks the discharge duct in the open state such that fluid can flow through the discharge duct in the open state. The closed state for example corresponds to at least one closed position of the valve element, wherein the open state for example corresponds to at least one open position of the valve element. The valve element is for example, in particular translationally and/or rotationally, movable between the closed position and the open position, in particular in relation to a housing of a valve device, which for example includes the housing, which is also referred to as valve housing, and the valve element.

In the closed state, the output element can be held in the holding position, by the fluid, in particular against the load, while blocking the discharge duct effected by the valve element. In other words, if the valve element is in the closed state, thus, fluid or an excessive amount of the fluid cannot flow from the output element or flow out of the output element, whereby the output element is held in the holding position by the fluid, which acts upon the output element or is for example in the output element.

However, in the open state, the valve element allows discharge of the fluid from the output element via the discharge duct and thereby a movement of the output element for example yielding to the load from the holding position into at least one yielding position different from the holding position. In other words, since the valve element unblocks the discharge duct in the open state, the fluid or an amount of the fluid larger with respect to the closed state can flow off or away from the discharge element since the fluid can flow through the discharge duct. As a result, the output element is no longer held in the holding position against the load by the fluid, such that the output element can yield or yields to the load and is moved from the holding position into the yielding position, in particular by the load. In other words, the output element can yield to the load in the open state of the valve element and thus bring itself into the yielding position. Hereby, the output element for example allows a movement of the previously mentioned component of the system from a first position, which the component occupies in the first state, into a second position different from the first position, which the component for example occupies in a second state different from the first state. Thus, the actuator device can allow or effect a transition of the system from the first state into the second state. In other words, the actuator device according to the invention can fast, robustly, and functionally securely effect switching of the system from the first state into the second state, in particular in that an adjustment of the valve element from the closed state into the open state is allowed or effected.

For example, the second state is an error or safety state, in which the system is at zero-force and/or zero-voltage and/or is braked for example to be able to avoid or at least keep low consequences resulting from an error or defect of the system.

Therein, the valve element is actuatable by the respective solid-state actuator via the coupling element by respectively activating the solid-state actuator and can thereby be brought into the closed state. For example, the valve element is actuatable by the respective solid-state actuator via the coupling element by respectively activating the solid-state actuator and can thereby be brought into the closed state and held in the closed state. In other words, for example in an initial state of the actuator device according to the invention, both activating the first solid-state actuator and activating the second solid-state actuator are omitted such that the valve element is in the open state of the valve element from the initial state. If the solid-state actuators are then alternately activated, in particular electrically activated, in the described manner, thus, the valve element is brought, in particular moved, from the open state into the closed state by the solid-state actuators and for example held in the closed state. In addition, the fluid is conveyed, in particular pumped, to the output element by the solid-state actuators, whereby the output element is applied with the fluid. Thereby, the output element is for example moved from the yielding position into the holding position, whereby the component is for example moved from the second position into the first position. In addition, the output element is held in the holding position and the component is also held in the first position. Thereby, the system is for example brought into the first state and held in the first state.

For example, if an error event then occurs, from which it results that both activation of the first solid-state actuator and activation of the second solid-state actuator are omitted at the same time, thus, fluid is no longer conveyed to the output element by the solid-state actuators and the solid-state actuators allow adjustment of the valve element from the closed state into the open state. As previously described, the output element can then move from the holding position into the yielding position, in particular under the load, and the system gets into the safe second state.

By the respective activation of the respective actuator, the respective actuator is for example deflected, that is deformed and therein for example enlarged. By the respective activation of the respective actuator, complete or else only half deflection of the respective actuator is for example effected. In other words, the respective actuator is for example only partially, only half or completely deflected by the respective activation. In particular, it is conceivable that both solid-state actuators are only partially, in particular only half, deflected or only one of the solid-state actuators is, in particular completely, deflected.

Within the scope of the invention, for example polymer actuators, piezo actuators and shape memory alloy actuators belong to the solid-state actuators, that is such actuators, which are formed at least of a shape memory alloy or at least include a shape memory alloy.

The invention is based on the realization that solid-state actuators have a high functional safety on the one hand and have a very high force density on the other hand. However, a disadvantage of conventional solid-state actuators is in that for example by activating a solid-state actuator, only low deflection of the solid-state actuator can be effected. By activation, it is for example to be understood that electrical energy, in particular electrical voltage, is applied to the respective solid-state actuator in activating the respective solid-state actuator or applying such an electrical voltage to respective solid-state actuators is omitted in the respective activation. Thus, during or in the respective active phase, it is for example provided that electrical energy, in particular electrical current, is applied to the respective solid-state actuator. Thus, in or during the respective inactive phase, it is for example provided that applying electrical energy or electrical voltage to the respective solid-state actuator is omitted. It is also inversely possible. By activating the respective actuator, a deformation and thus a deflection of the respective actuator is effected.

For example, to compensate for the disadvantage of the low deflection or the low mechanical energy, it can be provided to integrate deflections and thus the stored potential energy of the respective solid-state actuator over multiple cycles for example also formed as voltage cycles. However, unblocking usually has to be effected directly, that is without migration, since otherwise unblocking with high speed or in short time is only very difficultly realizable.

Now, the actuator device according to the invention allows particularly fast enabling a transition of the system from the first state into the second state since both solid-state actuators can act on the valve element common to the solid-state actuators via the coupling element common to the solid-state actuators. In other words, the actuator device according to the invention thereby allows to unblock the system particularly fast or in particularly short time with regard to a transition from the first state into the second state, such that, for example starting from the first state, the particularly safe second state of the system can be allowed or adjusted particularly fast and thus in short time.

In other words, the actuator device according to the invention allows to cause the system to transition from the first state into the second state or to effect such a transition in short time and thus in particularly fast manner. In the second state, the system is for example at zero-force and/or zero-voltage and/or braking of the system is effected such that a particularly safe state can be adjusted.

In order to realize a particularly high functional safety of the actuator device according to the invention, it is provided in an embodiment of the invention that the actuator device comprises at least one reservoir for receiving and storing the fluid.

A further embodiment is characterized in that at least or exactly one drive element is associated with the respective solid-state actuator, which is actuatable, in particular movable, by the respective solid-state actuator and by activating the respective solid-state actuator, whereby the fluid can be conveyed by the respective drive element with the output element. Thereby, the output element can for example be moved into the holding position or held in the holding position also against particularly high loads such that a particularly high functional safety of the actuator device can be presented.

For example, the reservoir is provided in addition to the actuators, in addition to the drive elements and in addition to the output element such that a particularly safe operation can be ensured.

In a particularly advantageous embodiment of the invention, in the respective inactive phase of the respective solid-state actuator following the respective activation of the respective solid-state actuator, the fluid can be sucked from the reservoir by the drive element, and by subsequent activation of the respective solid-state actuator, that is in the respective active phase of the respective solid-state actuator, it can be conveyed by the drive element from the respective drive element to the output element. Hereby, the actuators and the drive elements with them for example can be particularly fast switched between the respective active phase and the respective inactive phase since the development of an excessive negative pressure in the respective drive element can for example be avoided.

The discharge duct is for example fluidically connected to the reservoir or opens into the reservoir such that the fluid, which flows away or off from the output element while unblocking the discharge duct, flows into the reservoir and thus can be collected and stored in the reservoir.

A further embodiment is characterized in that a first one of the drive elements is actively movable or moved by the solid-state actuator associated with the second drive element via the coupling element as a result of the activation of the solid-state actuator associated with the second drive element in the inactive phase following the activation of the solid-state actuator associated with the first drive element such that the first drive element sucks the fluid from the reservoir. For example, the first solid-state actuator is associated with the first drive element and the second solid-state actuator is associated with the second drive element. Thus, the second solid-state actuator or the activation thereof causes the first drive element to be moved by the second solid-state actuator via the coupling element such that the first drive element sucks the fluid from the reservoir. Accordingly, the first solid-state actuator or the activation thereof for example causes the second drive element to be moved by the first solid-state actuator via the coupling element such that the second drive element sucks fluid from the reservoir. For example, while the first drive element sucks fluid from the reservoir, the second drive element conveys the fluid from the second drive element to the output element. Conversely, it is for example provided that if the second drive element sucks fluid from the reservoir, the first drive element conveys fluid from the first drive element to the output element. Hereby, the system can be particularly robustly held in the first state. At the same time, a particularly fast transition of the system from the first state into the second state can be allowed or effected.

The respective drive element is for example translationally movable, in particular along a direction of movement, in particular in relation to the respective drive housing. Therein, the respective drive element can for example be formed as a piston, wherein the respective drive element for example bounds a respective cylinder or a respective receiving space, in which the drive element can be movably arranged.

In a particularly advantageous embodiment of the invention, a first area, in which the respective drive element is, in particular translationally, movable by activating the respectively associated solid-state actuator, is sealed against the respective drive element and/or against a second area, in which the solid-state actuators are arranged, by an in particular elastically deformable membrane movable together with the respective drive element. Hereby, a particularly high functional safety of the actuator device can be ensured.

Therein, it has proven particularly advantageous if the coupling element is arranged in the first area. Hereby, a particularly fast transition from the first state into the second state can be ensured.

In order to be able to ensure a particularly high functional safety of the actuator device, it is provided in further configuration of the invention that the coupling element engages with a respective recess of the respective drive element. Alternatively or additionally, it is provided that the coupling element is movable together with the respective drive element.

It has furthermore proven particularly advantageous if the drive elements differ from each other with respect to their respective fluidically, in particular hydraulically, acting surface for conveying the fluid for example formed as a liquid. The fluidically acting surface for example extends perpendicularly to the direction of movement such that a force or a pressure is or can be exerted on the fluid via the surface by the respective drive element by moving the drive element, wherein the fluid is conveyed by the force or by the pressure.

One of the surfaces has a first value, wherein the other surface has a value greater or smaller with respect to the first value. Thus, the second surface is larger or smaller than the one surface. For example, if the one surface is larger than the other surface, thus, the fluid can be conveyed with a large force by the drive element having the one surface. In particular, by the drive element having the one surface, the fluid can be conveyed with a larger force, but with a lower speed than by the drive element having the other surface. In contrast, by the drive element having the other surface, the fluid can be particularly fast or faster conveyed, but with a lower force than by the drive element having the one surface. Thereby, the fluid can be particularly adequately conveyed.

In a particularly advantageous embodiment of the invention, the solid-state actuators are coupled to each other via the coupling element. Thereby, it can for example be ensured that the valve element is held in the closed state by one of the actuators, while the respectively other actuator is in its inactive phase, wherein the one actuator is for example in its active phase in the meantime, and vice versa. Thereby, a particularly high functional safety of the actuator device according to the invention can be ensured.

It has furthermore proven particularly advantageous if the solid-state actuators are coupled to each other via the coupling element and via the drive elements. Thereby, a construction particularly beneficial in installation space can be ensured such that a particularly high functional safety can be realized.

Further, it is conceivable that the solid-state actuators are coupled to each other via the coupling element and while bypassing the drive elements. Thereby, the actuators can particularly fast change between the respective active phase and the respective inactive phase.

In further configuration of the invention, the actuator device includes an electronic computing device also referred to as control unit, controller or control device, which is formed to alternately activate the solid-state actuators, such that upon activation of one of the solid-state actuators, the activation of the respectively other actuator is omitted and vice versa. Hereby, the solid-state actuators can operate as a pump to convey, in particular to pump, the fluid to the output element, and thus to hold the output element in the holding position, in particular against the load. At the same time, the respective solid-state actuator being in its active phase can hold the valve element in the closed state, while the respectively other solid-state actuator is in its inactive phase. Thus, undesired adjustment of the valve element from the closed state into the open state can be effectively prevented.

A further embodiment is characterized in that the computing device is formed to activate the respective solid-state actuator with a sinusoidal electrical current, wherein the sinusoidal currents for activating the solid-state actuators are phase-shifted to each other by 180 degrees. Thereby, a particularly simple, energy-efficient as well as robust activation can be ensured such that a particularly high robustness of the actuator device according to the invention can be presented.

Preferably, the sinusoidal currents are phase-shifted to each other by an angular amount, wherein the angular amount corresponds to 360 degrees divided by the number of the solid-state actuators. In other words, the angular amount results in that 360 degrees is divided by the number of the solid-state actuators. Thus, if the actuator device comprises exactly two solid-state actuators in the form of the previously mentioned solid-state actuators, thus, the angular amount is 180 degrees. For example, if the actuator device comprises exactly three solid-state actuators, thus, the angular amount is 120 degrees. If the actuator device for example comprises exactly four solid-state actuators, thus, the angular amount is 90 degrees.

In a particularly advantageous embodiment of the invention, the respective solid-state actuator is formed as a piezoelectric actuator, whereby a particularly high robustness and thus a high functional safety of the actuator device can be ensured.

For example, to be able to avoid undesired deformations of the actuators caused by temperature, and/or adjustments of the valve element, it has proven advantageous if the solid-state actuators are arranged in a housing also referred to as actuator housing, which is formed of Invar. A material or substance is to be understood by Invar, which is for example an iron-nickel alloy or at least includes such an iron-nickel alloy. In particular, an iron-nickel alloy with a very low thermal expansion coefficient is to be understood by Invar. Invar for example comprises 64 percent by volume or weight of iron and 36 percent by volume or weight of nickel. Other designations for Invar are for example Invar 36, Nilo Alloy 36, Nilvar, NS 36, Permalloy D, Radiometal 36 or Vacodil 36. For example, Invar has the material number 1.3912. In particular, Invar 65 can comprise 65 percent by weight or volume of iron and 35 percent by volume or weight of nickel. In particular, it is conceivable that Invar comprises nickel in a range of 33 percent by weight or volume inclusive up to 36 percent by weight or volume inclusive as well as iron in a range of 62 percent by weight or volume inclusive up to 65 percent by weight or volume inclusive. Further, Invar can comprise cobalt in a range of 4 percent by weight or volume inclusive up to 5 percent by weight or volume inclusive.

For example, if particularly high powers are provided or required, thus, the actuator device can be particularly simply extended by further solid-state actuators such that the actuator device can readily comprise more than two solid-state actuators. By the arrangement of the solid-state actuators in the housing of Invar, an at least substantially constant and constantly high performance of the actuator device can be provided, in particular at least substantially dependent on temperature influences. This has proven advantageous particularly in the use of the actuator device in a brake system or for a brake system since especially in brake systems, it is conventionally difficult to ensure consistent response times and forces independently of the use and thereby heating. This is possible by employment of the actuator device according to the invention.

A great advantage of the actuator device according to the invention is in the possibility of being able to realize a consistent electrification of safety systems. In other words, the actuator device according to the invention can be particularly advantageously realized for a safety system to be able to bring about the safe second state in fast and robust manner. Compared to conventional devices, pneumatic and/ or hydraulic components can be omitted and a higher flexibility in the design can be realized. In addition, cost and weight can be saved with better capability of regulating and/or controlling the actuator device at the same time. Further, it is conceivable that additional sensors for state monitoring can be completely omitted. Further, it is conceivable that switching times for unblocking the discharge duct down to below one millisecond can be realized by the coupling of the actuators via the coupling element using the valve element for example functioning as a switch valve, which is of advantage particularly for safety applications. Heretofore, such a short switching time is not realizable with mechanical systems. Unblocking the discharge duct, that is switching or adjusting or bringing the valve element from the closed state into the open state, is for example opening the actuator device, since the fluid or a sufficiently large amount of the fluid is discharged from the output element, in particular under the effect of the load, by unblocking the discharge duct such that a transition of the system from the first state into the second state is allowed or effected, and this in very short time, that is with a high speed.

Finally, it has proven advantageous if the solid-state actuators differ from each other with respect to their respective functional principle. This means that one of the actuators is a solid-state actuator of a first type and the other actuator is a solid-state actuator of a second type different from the first type. For example, if the one actuator is a piezo actuator, thus, the second actuator is for example a shape memory alloy actuator or a polymer actuator. Thereby, the fluid can be particularly advantageously conveyed.

A second aspect of the invention relates to a method for operating an actuator device, in particular an actuator device according to the invention. In the second aspect of the invention, the actuator device comprises at least one output element, which can be applied with a fluid, in particular a liquid, and thereby is movable into a holding position and can be held in the holding position for example against a load acting on the output element. In the second aspect of the invention, the actuator device comprises at least one first solid-state actuator and at least one second solid-state actuator, which are alternately activated, in particular by the electronic computing device, whereby the fluid is conveyed to the output element and the output element is applied with the fluid. In the second aspect of the invention, the actuator device comprises a coupling element common to the solid-state actuators with at least one discharge duct, via which the fluid can be discharged from the output element. In addition, according to the second aspect of the invention, the actuator device comprises at least one valve element, which is actuated by the respective solid-state actuator via the coupling element by the respective activation of the respective solid-state actuator and thereby is brought into a closed state blocking the discharge duct and held in the closed state, in which the output element is held in the holding position by the fluid, in particular against the load, while blocking the discharge duct.

If both activation of the first solid-state actuator and activation of the second solid-state actuator are omitted at the same time, the valve element shifts from the closed state into an open state unblocking the discharge duct, in which the valve element allows discharge of the fluid from the output element into the discharge duct or at least a part of the fluid is discharged from the output element via the discharge duct. Hereby, the output element yields to the load and moves from the holding position into at least one yielding position different from the holding position, wherein the output element for example translationally and/or rotationally moves from the holding position into the yielding position. Advantages and advantageous configurations of the first aspect of the invention are to be regarded as advantages and advantageous configurations of the second aspect of the invention and vice versa.

By the feature that the output element moves from the holding position into the yielding position, it can be understood that the output element is moved from the holding position into the yielding position, in particular by the load acting on the output element. Thus, the adjustment of the valve element from the closed state into the open state for example allows a movement of the output element from the holding position into the yielding position. Further, by the feature that the output element moves from the holding position into the yielding position, it can be understood that at least a part or a partial area of the output element moves from the holding position into the yielding position.

The actuator device according to the invention and/or the method according to the invention can be particularly advantageously used for a parking lock of a transmission of a motor vehicle. In other words, the previously mentioned system is for example formed as a parking lock of a transmission of a motor vehicle. The transmission for example comprises at least one shaft, which can be coupled or is coupled to at least one or multiple wheels of the motor vehicle such that the at least one wheel is drivable by the shaft and/or vice versa. The motor vehicle is supported on a ground to the bottom in vehicle vertical direction via the at least one wheel. Basically, the shaft is rotatable around a rotational axis in relation to a housing of the transmission, wherein the shaft is for example at least partially accommodated in the housing.

Therein, the parking lock includes a ratchet wheel rotationally fixedly connected to the shaft, which comprises at least one or multiple recesses. The recesses are for example formed by a toothing and arranged between respective teeth of the toothing in circumferential direction of the ratchet wheel. The ratchet wheel can be a component formed separately from the shaft and rotationally fixedly connected to the shaft, or the ratchet wheel is formed integrally with the shaft.

Moreover, the parking lock includes a pawl, which is movable, in particular pivotable, between at least one blocking position and at least one release position, in particular in relation to the housing and/or in relation to the shaft. For example, the pawl is at least indirectly retained at the housing.

In the blocking position, the pawl cooperates with the ratchet wheel in form-fit manner in that the pawl engages with the recess or with one of the recesses. Thereby, the ratchet wheel and the shaft rotationally fixedly connected to the ratchet wheel are secured against a rotation occurring around the rotational axis in relation to the housing via the pawl. Thereby, the shaft cannot rotate in relation to the housing such that the wheel either cannot rotate. Thereby, the motor vehicle for example parked on a slope is secured against undesired rolling away.

Now, the actuator device is for example formed to move the pawl from the blocking position into the release position by conveying the fluid. In other words, by moving the output element into the holding position, the pawl is for example moved into the release position. By allowing the movement of the output element from the holding position into the yielding position, the actuator device for example allows a movement of the pawl from the release position into the blocking position and by allowing the movement of the output element from the holding position into the yielding position, the actuator device for example effects a movement of the pawl from the release position into the blocking position, respectively. For example, at least one spring is provided, which is tensioned at least in the release position and thereby provides a spring force at least in the release position, which at least indirectly acts on the pawl.

Thus, the actuator device can move the pawl into the release position against the spring force and/or hold it in the release position. If the movement of the output element into the yielding position is allowed, thus, it is allowed that the spring at least partially relaxes. Hereby, the pawl is particularly fast moved into the blocking position by the spring force. Alternatively or additionally, the output element is for example moved into the yielding position by the spring force or the spring force can assist the movement of the output element into the yielding position. Thus, the actuator device allows moving the pawl into the release position in adequate and sufficiently fast manner on the one hand. In addition, the actuator device can effect or allow a particularly fast movement of the pawl into the blocking position.

Further advantages, features and details of the invention are apparent from the following description of preferred embodiments as well as based on the drawing. The features and feature combinations mentioned above in the description as well as the features and feature combinations mentioned below in the description of figures and/or shown in the figures alone are usable not only in the respectively specified combination, but also in other combinations or alone without departing from the scope of the invention.

BRIEF DESCRIPTION OF THE DRAWINGS

The drawings show in.

In the figures, identical or functionally identical elements are provided with identical reference characters.

DESCRIPTION OF THE PREFERRED EMBODIMENTS

Figure 1:
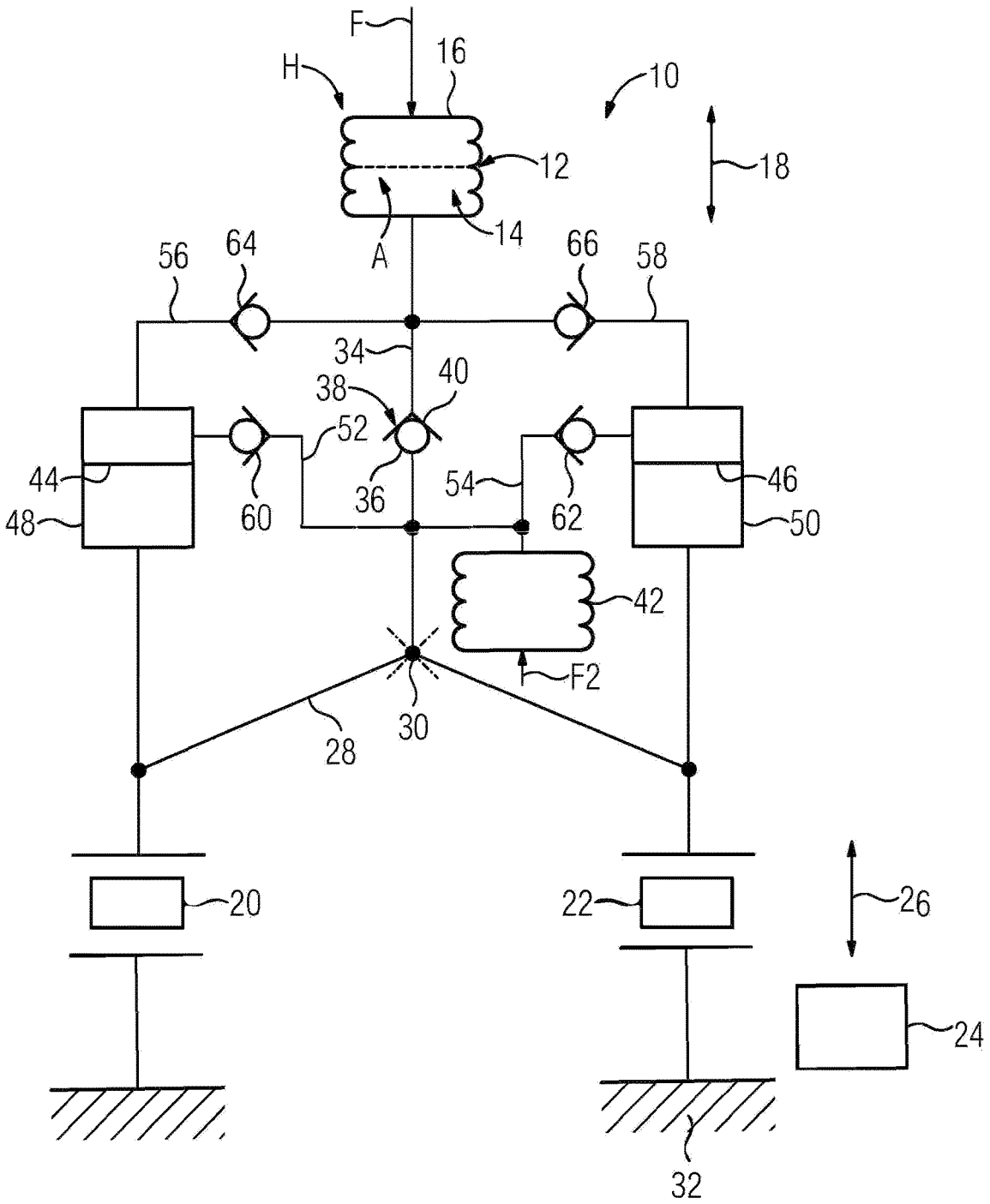
FIG. 1 a schematic representation of a first embodiment of an actuator device according to the invention, in particular for a system such as for example a brake system.

FIG. 1 shows an actuator device denoted by 10 as a whole in a schematic representation, which is for example used in or for a system, in particular safety system. The mentioned system for example comprises at least one component, which provides a load and exerts it on the actuator device 10, in particular in a first state of the system. This load is illustrated in FIG. 1 by an arrow F also referred to as force arrow. The system for example occupies the first state during a normal operation of the system, wherein the system does not have an error or defect during the normal operation. In the first state, the system is for example under tension and/or force or braking the system is omitted in the first state.

The actuator device 10 comprises at least or exactly one output element 12, which is for example coupled or can be coupled to the mentioned component. Thus, the component exerts the load denoted by the arrow F and for example formed as a force on the output element 12. The output element 12 is for example a bellows. Alternatively or additionally, the output element 12 for example comprises at least or exactly one chamber 14, which can be supplied with a fluid, in particular with a liquid. This means that the fluid can for example be introduced into the chamber 14 and conducted out of the chamber 14 or discharged from the chamber 14. By introducing the fluid into the chamber 14, the output element 12 is applied with the fluid. At least a partial area 16 of the output element 12 also referred to as part at least partially bounds the chamber 14 such that at least the partial area 16 can be applied with the fluid, in particular in that the fluid is conducted or introduced into the chamber 14.

Thus, the output element 12, in particular the partial area 16, can be applied with the fluid and is thereby movable into a holding position H shown in FIG. 1 as well as can be held in the holding position for example against the load.

For example, if the fluid is discharged from the chamber 14 such that the fluid is discharged from the output element 12 or from the partial area 16, thus, the partial area 16 or the output element 12 can evade or yield to the load, whereby the partial area 16 or the output element 12, in particular translationally, moves from the holding position H into a yielding position A for example illustrated by a dashed line. Thus, the partial area 16 is for example, in particular translationally, movable between the holding position H and the yielding position A along a direction of movement illustrated by a double arrow 18 in FIG. 1.

The actuator device 10 comprises at least one first solid-state actuator 20 and at least one second solid-state actuator 22. The solid-state actuators 20 and 22 are also simply referred to as actuators and are for example formed as piezoelectric actuators. Thus, the respective actuator is for example also referred to as piezo actuator. Within the scope of a method for operating the actuator device 10, the actuators are alternately activated by an electronic computing device 24 of the actuator device 10 particularly schematically illustrated in FIG. 1, whereby the fluid is conveyed, in particular pumped, to the output element 12 and therein for example into the chamber 14 by the respective actuator. Hereby, the output element 12, in particular the partial area 16, is applied with the fluid. The respective solid-state actuator 20 and 22, respectively, can be formed as a piezo actuator or else as a polymer actuator or else as a shape memory alloy actuator, that is as such an actuator, which comprises and uses at least one shape memory alloy to convey the fluid.

Within the scope of the activation, an electrical energy, in particular an electrical current or an electrical voltage, is for example applied to the respective actuator. In that the respective actuator is alternately activated, inactive phases and active phases of the respective actuator consecutively alternate, wherein during or in the respective active phase of the respective actuator, activation of the respective actuator is effected or the respective actuator is activated. In or during the respective inactive phase of the respective actuator, an activation of the respective actuator is omitted. By activating the respective actuator, a deformation of the respective actuator is effected, in particular such that a deformation of the respective actuator occurs along a deformation direction illustrated by a double arrow 26 in FIG. 1. For example, the respective actuator is enlarged along the deformation direction by activating the respective actuator such that a length increase of the respective actuator extending along the deformation direction is effected by activating the respective actuator. By terminating the activation of the respective actuator, a length reduction of the respective actuator along the deformation direction for example occurs.

Moreover, the actuator device 10 comprises a coupling element 28 common to the solid-state actuators 20 and 22, which is for example formed as a rocker pivotable around a pivot axis 30, in particular in relation to a housing 32 particularly schematically illustrated in FIG. 1. Further, the coupling element 30 and thus the pivot axis 30 can for example be translationally moved, in particular in relation to the housing 32, along the deformation direction. For example, the actuators are at least partially, in particular at least predominantly or completely, accommodated in the housing 32 also referred to as actuator housing. The respective actuator is at least indirectly, in particular directly, supported on the housing 32 on the one hand. On the other hand, the respective actuator is coupled to the coupling element 28 and to the respectively other actuator via it.

Moreover, the actuator device 10 comprises at least one discharge duct 34, via which the fluid can be discharged from the chamber 14 and thus from the output element 12, in particular the partial area 16. Thus, if the fluid for example first received in the chamber 14 is discharged from the chamber 14 via the discharge duct 34, thus, the partial area 16 can thereby be moved from the holding position H into the yielding position A by the load.

Furthermore, the actuator device 10 comprises a valve element 36 for example formed as a ball, which is presently a constituent of a check valve 38. The check valve 38 is arranged in the discharge duct 34 and comprises the valve element 36 and a corresponding second valve element 40. The valve element 40 for example forms a valve seat for the valve element 36. The valve element 36 is movable, in particular along the deformation direction and/or in translational manner, in relation to the valve element 40 and/or in relation to the housing 32 between at least one open position unblocking the discharge duct 34 and at least one closed position fluidically blocking the discharge duct 34. In the closed position, the valve element 36 seats on the corresponding valve seat formed by the valve element 40. If the valve element 36 is in the closed position, thus, the valve element 36 is in a closed state. If the valve element 36 is in the open position, thus, the valve element 36 is in the open state. The valve element 36 is also coupled to the coupling element 28 and thus coupled to the actuators via the coupling element 28.

In the closed state or in the closed position, the output element 12, in particular the partial area 16, is held in the holding position H by the fluid located in the chamber 14 while blocking the discharge duct 34 effected by the valve element 36. In the open state or in the open position, the valve element 36 allows discharging the fluid from the output element 12 or from the chamber 14 and thus from the partial area 16 via the discharge duct 34, whereby the valve element 36 allows a movement of the output element 12 or of the partial area 16 from the holding position H into the yielding position A. Therein, the valve element 36 can be actuated by the respective solid-state actuator 20 or 22 via the coupling element 28 by the respective activation of the respective solid-state actuator 20 or 22 and thereby can be brought into the closed state or is movable into the closed position and can be held in the closed state or in the closed position.

Moreover, the actuator device 10 comprises at least one reservoir 42 for receiving and storing the fluid. In particular, under the effect of a load acting on the reservoir 42 and illustrated by an arrow F2 in FIG. 1, the reservoir 42 for example formed as a bellows can provide the fluid first received in the reservoir 42. Preferably, the fluid is a liquid such that the actuator device 10 can be a hydraulic actuator device.

Moreover, a first drive element 44 for example formed as a piston is associated with the first solid-state actuator 20, and a second drive element 46 for example formed as a piston is associated with the second solid-state actuator 22. The respective drive element 44 and 46, respectively, is for example, in particular translationally, movable along the deformation direction. The piston is for example translationally movably accommodated in a drive housing 48 and 50, respectively. For example, if the respective solid-state actuator 20 and 22, respectively, is activated, thus, the respective piston is thereby for example displaced in a first displacement direction coinciding with the deformation direction in particular in relation to the drive housing 48 and 50, respectively. Thereby, fluid is conveyed out of the drive housing 48 and 50, respectively, and conveyed to the output element 12 and therein into the chamber 14. Hereby, the partial area 16 is for example applied with the fluid. If a length reduction of the respective actuator occurs in the respective inactive phase of the respective actuator, thus, the respective drive element 44 and 46, respectively, moves in a second displacement direction opposite to the first displacement direction and coinciding with the deformation direction in relation to the drive housing 48 and 50, respectively. Hereby, fluid is for example sucked from the reservoir 42 by the respective drive element 44 and 46, respectively, via a respective conduit 52 and 54, respectively, and sucked into the respective drive housing 48 and 50. In moving the respective drive element 44 and 46, respectively, in the first displacement direction, the fluid flows from the respective drive housing 48 and 50, respectively, into a respective conduit 56 and 58, respectively, through which the fluid is conducted from the respective drive housing 48 and 50, respectively, to the output element 12 and therein for example into the chamber 14. Overall, it is apparent that the respective drive element 44 and 46, respectively, is actuatable, in particular movable, by activating the respective actuator and therein by the respective actuator itself, whereby the fluid can be conveyed or is conveyed from the respective drive element 44 and 46, respectively, to the output element 12.

During the first state, the actuators are alternatively activated such that the solid-state actuator 20 is for example in its active phase, while the solid-state actuator 22 is in its inactive phase, and such that the solid-state actuator 22 is in its active phase, while the solid-state actuator 20 is in an inactive phase. Hereby, the valve element 36 is held in the closed state in the first state of the system and the partial area 16 is held in the holding position H.

If and preferably only if both activation of the solid-state actuator 20 and activation of the solid-state actuator 22 are omitted at the same time, the valve element 36 moves, in particular by a pressure of the fluid acting on the valve element 36, from the closed position into the open position, whereby the partial area moves from the holding position H into the yielding position A. As a result, the system is for example switched to zero-voltage and/or zero-force and/or the system is braked.

The previously mentioned pressure of the fluid acting on the valve element 36 for example results from the fact that the load illustrated by the arrow F acts on the fluid received in the chamber 14 via the partial area 16, which can for example act on the valve element 36 via the discharge duct 34 for example formed as a discharge conduit. Thus, the valve element 36 can for example be held in the closed position against the load by alternately activating the actuators. If activation of the solid-state actuator 20 and activation of the solid-state actuator 22 are omitted at the same time, thus, the valve element 36 and also the partial area 16 can yield to the load and move into the open position or into the initial position A.

It is apparent from FIG. 1 that a check valve 60 is arranged in the conduit 52, which opens in the direction of the drive element 44 or in the direction of the drive housing 48 and closes in opposite direction. Thereby, the drive element 44, if it moves in the second displacement direction, can suck fluid from the reservoir 42 via the conduit 52. In the conduit 54, a check valve 62 is arranged, which opens in the direction of the drive element 46 or opens in the direction of the drive housing 50 and closes in the opposite direction. Thereby, the drive element 46 can, if it moves in the second displacement direction, suck fluid from the reservoir 42 via the conduit 54 and the check valve 62.

A check valve 64 is arranged in the conduit 56, which opens in the direction of the output element 12 and closes in opposite direction. Thereby, the drive element 44 can, if it moves in the first displacement direction, convey fluid out of the drive housing 48 and convey it through the conduit 56 and convey it to the or into the output element 12. Accordingly, a check valve 66 is also arranged in the conduit 58, which blocks in the direction of the drive element 46 and opens in the opposite direction. Thereby, the drive element 46 can, if it moves in the first displacement direction, convey the fluid out of the drive housing 50 and convey it through the conduit 58, whereby the drive element 46 can convey the fluid from the drive housing 50 to the or into the output element 12.

The coupling element 28 is preferably rigid or not elastic, in particular not rubbery-elastic. In particular, the coupling element 28 is inherently rigid and dimensionally stable, respectively. In particular, the coupling element 28 can be formed as a rocker arm. Therein, the valve element 36 functions as a switch valve, which is actuated with the aid of the two solid-state actuators 20 and 22 connected to each other by the coupling element 28.

In an initial state, the switch valve is for example first open. In this initial state, activation of the actuators is omitted. In other words, the actuators are at zero-voltage in the initial state. In order to close the switch valve, that is to move the valve element 36 from the open position into the closed position, an electrical voltage is applied to the actuators or an electrical voltage is applied to only one of the actuators such that both actuators are for example half deflected or only one of the actuators is completely deflected. Hereby, the valve element 36 is closed and pretensioned. Due to the kinematics realizable by the use of the coupling element 28, it does not make a difference if one of the actuators is fully deflected or both actuators are half deflected. For the operation of the actuators, a sinusoidal activation of the actuators offset or phase-shifted to each other by 180 degrees is selected, whereby a pump is realized without opening the switch valve, since a closing force for holding the switch valve in the closed position is realized via the mechanical coupling element 28 and not via a hydraulic pressure in the actuator device 10. This means that the fluid can be pumped to and into the output element 12 by the actuators, while the valve element 36 remains in the closed position.

In the presently shown embodiment, the actuator device 10 comprises the exactly two actuators. Alternatively thereto, it is conceivable that at least one or more further solid-state actuators are provided in addition to the two actuators, which are coupled to each other via the coupling element 28, such that the valve element 36 can be actuated by the respective solid-state actuator via the coupling element 28. For the operation of the actuators, the number of which is at least two, three, four or greater, a sinusoidal activation of the actuators offset or phase-shifted to each other by an angular amount is selected, whereby the previously described pump is realized. Therein, the angular amount results from 360 degrees divided by the number of the actuators.

Only if both solid-state actuators 20 and 22 are switched to zero-voltage at the same time, the valve element 36 (switch valve) opens, whereby a pressure, in particular of the fluid, also referred to as system pressure and for example existing in the chamber 14 is relieved. By pumping the fluid, a pressure build-up is effected in the hydraulic output element 12, in particular the chamber 14. This pumping and thereby the pressure build-up in the output element 12 are effected via the alternate activation, also referred to as actuation, of the actuators, whereby an alternate actuation of the two hydraulic drive elements 44 and 46 is realized. By the use of the check valves 60, 62, 64 and 66 and by the arrangement thereof, it is ensured that in each cycle, that is in each activation of the respective actuator, either fluid is pumped from the respective drive housing 48 and 50, respectively, into the output element 12 for pressure increase or fluid is sucked and thus re-conveyed from the reservoir 42 functioning as a hydraulic compensation element into the respective drive housing 48 and 50, respectively.

The activation of the actuators offset or phase-shifted to each other by 180 degrees can be presented by particularly simple and thus inexpensive power electronics since the activation can be effected at least nearly without reactive power. The reason for this is that the electrical energy can always be shifted back and forth between the two capacitances of the actuators by this activation. For example, if a fixed turnaround frequency is selected with the aid of an inductance, a clocked final stage along with the filters required thereto can additionally be omitted.

Preferably, the valve element 36 comprises at least one hydraulically active surface. A pressure of the fluid acting on the valve element 36 can be captured via this surface and for example by a pressure sensor. As a result, the system pressure can be captured, in particular determined, by the good electromechanical coupling, whereby, in particular permanent, pressure monitoring is allowed.

Figure 2:
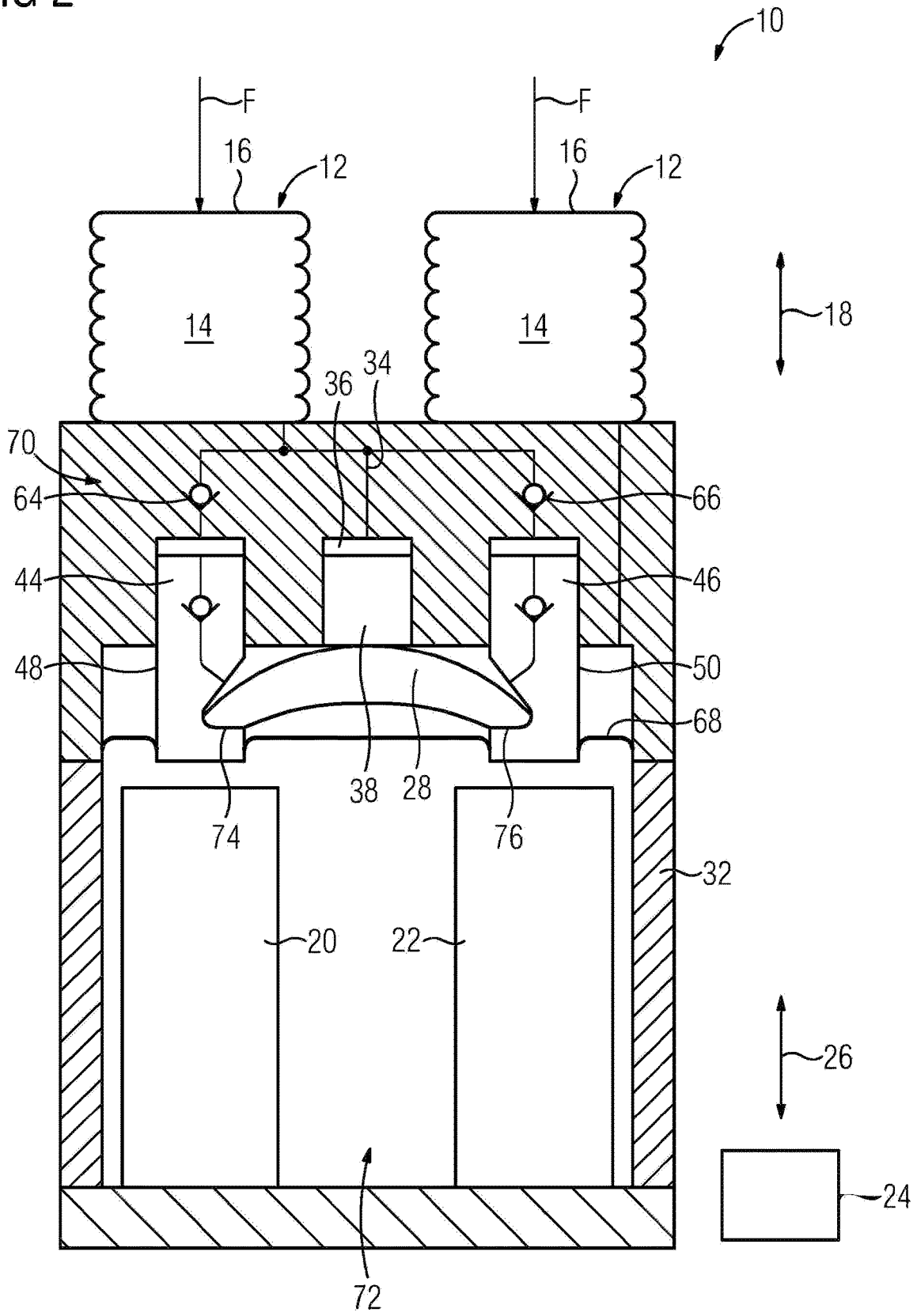
FIG. 2 a schematic representation of a second embodiment of the actuator device.

FIG. 2 shows a second embodiment of the actuator device 10. In the second embodiment, two output elements 12 are for example provided and the output element 12 comprises two output parts. In the second embodiment, the housing 32 is formed of Invar such that an advantageous temperature compensation is realizable. Therein, the actuators are accommodated in the housing 32. In the second embodiment, the actuator device 10 comprises an, in particular elastically deformable, membrane 68. For example, a first area 70, in which the respective drive element 44 and 46, respectively, is movable, is sealed against the respective drive element 44 and 46, respectively, or against the respective drive housing 48 and 50, respectively, and/or against the housing 32 and/or against a second area 72, in which the solid-state actuators 20 and 22 are arranged, by the membrane 68. In other words, sealing of the two hydraulic drive elements 44 and 46 is effected by the membrane 68 in the second embodiment.

In the second embodiment, the coupling element 28 is connected to the drive elements 44 and 46 such that the coupling element 28 engages with a respective recess 74 and 76, respectively, for example formed as a milled groove of the respective drive element 44 and 46, respectively, for example formed as a piston.

The previously mentioned temperature compensation for the solid-state actuators 20 and 22 is implemented such that the for example parallel housing 32 is formed of an advantageous material such as for example Invar. Thereby, upon a temperature variation, an undesired opening of the switch valve caused by different temperature expansion coefficients, in particular of the actuators, can be prevented.

The actuator device 10 can be formed as an integrating actuator unit with quick release function, wherein the actuator device 10 is an integrating actuator unit in that the fluid is pumped to the and in particular into the output element 12 by alternately activating the solid-state actuators 20 and 22. The previously mentioned quick release function can be simply presented without integrating process in that the solid-state actuators 20 and 22 are switched to zero-voltage such that both activation of the first solid-state actuator 20 and activation of the second solid-state actuator 22 are omitted at the same time. Thereby, a fast transition of the system from the first state into the second state can be allowed or effected.

The actuators can function or be operated like a so-called electronic vane. By activating the respective actuator, that is by applying an electrical current to the respective actuator, the respective actuator for example expands. If the activation is terminated, thus, the respective actuator again contracts. Then or at the moment when or at which one of the actuators contracts, electrical charge is shifted from the one actuator to the or into the other actuator and vice versa. Thereby, the mentioned electronic vane is realized.

A further advantage of the invention is in that the actuators can be operated or alternately activated with a very low frequency of less than 10 Hertz to remain in position. Thereby, depolarization or reverse polarization of the actuators for example formed as piezo actuators can be avoided.

Furthermore, it is possible to realize a force limitation via corresponding arrangement of the actuators. In particular, there are at least two possibility of presenting such an advantageous force limitation: In a first one of the possibilities, the realization of a force limitation is effected by correspondingly dimensioning the actuators. Thereby, it can be ensured that the valve element 36 is, in particular always, opened, that is adjusted into the open state, if a force for example acting on the output element 12 reaches or exceeds a threshold value. By correspondingly dimensioning the actuators, the threshold value dan be adjusted or preset. In other words, if the force reaches or exceeds the threshold value, thus, the valve element 36 opens.

Hereby, the valve element 36 is for example adjusted into the open state, in particular also, if the force exceeds the threshold value, while the actuators or at least or exactly one of the actuators is activated. In the second possibility, the force limitation can be realized via a so-called offset or basic voltage, in particular of the activation of the respective actuator. The activation of the respective actuator has at least or exactly two voltage portions: A first one of the voltage portions is the basic voltage, which is a basic voltage increase above the zero line. The second voltage portion is a sine wave for realizing the sinusoidal activation or the sinusoidal current. The sine wave for example adjusts the speed, with which it is pumped. By adjusting the basic voltage, the threshold value or the force limitation can for example be adjusted. Thereby, the actuators can be formed as inherently safe actuators.

The invention claimed is:

1. An actuator device comprising:

at least one output element which can be applied with a fluid and is thereby movable into a holding position, at least two solid-state actuators which can be alternately activated, whereby the fluid can be conveyed to the output element and the output element can be applied with the fluid, a coupling element common to the solid-state actuators, at least one discharge duct via which the fluid can be discharged from the output element, and at least one valve element which is adjustable between at least one closed state blocking the discharge duct and at least one open state unblocking the discharge duct, wherein:

in the closed state, the output element can be held in the holding position by the fluid while blocking the discharge duct, and in the open state, the valve element allows discharge of the fluid from the output element via the discharge duct and thereby a movement of the output element from the holding position into at least one yielding position, wherein the valve element can be actuated and thereby brought into the closed state by the respective solid-state actuator via the coupling element by respectively activating the solid-state actuator.

2. The actuator device according to claim 1, wherein at least one reservoir for receiving and storing the fluid is provided.

3. The actuator device according to claim 2, wherein a respective drive element is associated with the respective solid-state actuator, which is actuatable, by the respective solid-state actuator by activating the respective solid-state actuator, whereby the fluid can be conveyed to the output element.

4. The actuator device according to claim 3, wherein in a respective phase of the respective solid-state actuator following the respective activation of the respective solid-state actuator, the fluid can be sucked from the reservoir by the respective drive element, and by subsequent activation of the respective solid-state actuator, it can be conveyed from the respective drive element to the output element by the respective drive element.

5. The actuator device according to claim 4, wherein a first one of the drive elements is actively movable by the solid-state actuator associated with the second drive element via the coupling element as a result of the activation of the solid-state actuator associated with the second drive element in the phase following the activation of the solid-state actuator associated with the first drive element such that the first drive element sucks the fluid from the reservoir.

6. The actuator device according to claim 3, wherein a first area, in which the respective drive element is movable by activating the respectively associated solid-state actuator, is sealed against the respective drive element and/or against a second area, in which the solid-state actuators are arranged, by a membrane.

7. The actuator device according to claim 6, wherein the coupling element is arranged in the first area.

8. The actuator device according to claim 6, wherein the membrane is elastically deformable and/or movable together with the respective drive element.

9. The actuator device according to claim 3, wherein the coupling element engages with a respective recess of the respective drive element and/or is movable together with the respective drive element.

10. The actuator device according to claim 3, wherein the drive elements differ from each other with respect to their respective fluidically active surface for conveying the fluid.

11. The actuator device according to claim 1, wherein the solid-state actuators are coupled to each other via the coupling element.

12. The actuator device according to claim 1, wherein the coupling element is formed as a rocker pivotable around a pivot axis.

13. The actuator device according to claim 1, wherein an electronic computing device is provided, which is formed to alternately activate the solid-state actuators such that upon activation of one of the solid-state actuators, the activation of the other actuator is omitted and vice versa.

14. The actuator device according to claim 13, wherein the computing device is formed to activate the respective solid-state actuator with a sinusoidal, electrical current, wherein the sinusoidal currents for activating the solid-state actuators are phase-shifted relative to each other by 180°.

15. The actuator device according to claim 1, wherein the solid-state actuators are arranged in a housing, which is formed of Invar, and/or wherein the solid-state actuators differ from each other with respect to their respective functional principle.

16. A method for operating an actuator device comprising:

applying a fluid to at least one output element which is thereby movable into a holding position;

alternately activating at least one first solid-state actuator and at least one second solid-state actuator, whereby the fluid is conveyed to the output element and the output element is applied with the fluid;

a coupling element being common to the solid-state actuators;

discharging the fluid via at least one discharge duct from the output element; and actuating at least one valve element by the respective solid-state actuator via the coupling element by respectively activating the respective solid-state actuator and thereby bringing the valve element into a closed state blocking the discharge duct, in which the output element is held in the holding position by the fluid while blocking the discharge duct, wherein the valve element shifts from the closed state into an open state unblocking the discharge duct, in which the valve element allows discharge of the fluid from the output element via the discharge duct, if both activation of the first solid-state actuator and activation of the second solid-state actuator are omitted at the same time, whereby the output element moves from the holding position into at least one yielding position.

* * * * *